US010483064B2

(12) United States Patent
Kobayashi

(10) Patent No.: US 10,483,064 B2
(45) Date of Patent: Nov. 19, 2019

(54) ELECTROMAGNETIC DEVICE, AND ELECTROMAGNETIC RELAY USING SAME

(71) Applicant: Panasonic Intellectual Property Management Co., Ltd., Osaka (JP)

(72) Inventor: Masakazu Kobayashi, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 90 days.

(21) Appl. No.: 15/571,831

(22) PCT Filed: Jun. 27, 2016

(86) PCT No.: PCT/JP2016/003076
§ 371 (c)(1),
(2) Date: Nov. 5, 2017

(87) PCT Pub. No.: WO2017/002350
PCT Pub. Date: Jan. 5, 2017

(65) Prior Publication Data
US 2018/0277324 A1 Sep. 27, 2018

(30) Foreign Application Priority Data
Jul. 1, 2015 (JP) ..... 2015-133102

(51) Int. Cl.
*H01H 50/36* (2006.01)
*H01H 50/56* (2006.01)
(Continued)

(52) U.S. Cl.
CPC ..... *H01H 50/36* (2013.01); *H01H 50/56* (2013.01); *H01H 50/20* (2013.01); *H01H 50/40* (2013.01); *H01H 51/065* (2013.01)

(58) Field of Classification Search
CPC ..... H01H 50/36; H01H 50/56; H01H 50/20; H01H 50/40; H01H 51/065
See application file for complete search history.

(56) References Cited

U.S. PATENT DOCUMENTS 5,032,812 A * 7/1991 Banick ..... F16K 31/082 335/17
5,892,194 A * 4/1999 Uotome ..... H01H 1/34 218/68
(Continued)

FOREIGN PATENT DOCUMENTS

CN 1327604 A 12/2001
JP 2014-203782 10/2014
(Continued)

OTHER PUBLICATIONS

International Search Report of PCT application No. PCT/JP2016/003076 dated Sep. 6, 2016.
(Continued)

*Primary Examiner* — Mohamad A Musleh
(74) *Attorney, Agent, or Firm* — McDermott Will & Emery LLP

(57) ABSTRACT

An electromagnetic device includes an excitation coil, a stator magnetically combined with the excitation coil, a movable element configured to, when current is flown in the excitation coil, be attracted to the stator by magnetic flux generated at the excitation coil to move in a first direction, and move to a position to be in contact with the stator, a yoke having a first end and a second end, and forming a part of a magnetic path for the magnetic flux generated at the excitation coil, and a yoke extension connected to the second end of the yoke and magnetically combined with the yoke, the stator, and the movable element. An end of the yoke extension in the first direction is positioned on a side of the first direction with respect to an end of the stator in the second direction.

6 Claims, 8 Drawing Sheets

(51) Int. Cl.

| | |
|---|---|
| *H01H 50/20* | (2006.01) |
| *H01H 50/40* | (2006.01) |
| *H01H 51/06* | (2006.01) |

(56) References Cited

U.S. PATENT DOCUMENTS

| | | | | |
|---|---|---|---|---|
| 6,700,466 | B1 | 3/2004 | Yamamoto et al. | |
| 6,911,884 | B2 * | 6/2005 | Uotome | H01H 47/06 335/132 |
| 7,876,183 | B2 * | 1/2011 | Uruma | H01H 50/04 335/126 |
| 8,395,463 | B2 * | 3/2013 | Ito | H01H 9/34 335/78 |
| 8,797,129 | B2 * | 8/2014 | Naka | H01H 50/36 335/126 |
| 9,082,576 | B2 * | 7/2015 | Nishimura | H01H 50/643 |
| 9,269,507 | B2 * | 2/2016 | Enomoto | H01H 50/546 |
| 9,466,450 | B2 * | 10/2016 | Takaya | H01H 50/163 |
| 9,799,474 | B2 * | 10/2017 | Sakai | H01H 50/026 |
| 2016/0181038 | A1 | 6/2016 | Shimizu et al. | |

FOREIGN PATENT DOCUMENTS

| | | |
|---|---|---|
| JP | 2015-046274 A | 3/2015 |
| JP | 2015-046377 | 3/2015 |
| KR | 10-1072628 B1 | 10/2011 |

OTHER PUBLICATIONS

English Translation of Chinese Office Action and Search Report dated Dec. 12, 2018 for the related Chinese Patent Application No. 201680031451.9.

* cited by examiner

ELECTROMAGNETIC DEVICE, AND ELECTROMAGNETIC RELAY USING SAME

This application is a U.S. national stage application of the PCT International Application No. PCT/JP2016/003076 filed on Jun. 27, 2016, which claims the benefit of foreign priority of Japanese patent application 2015-133102 filed on Jul. 1, 2015, the contents all of which are incorporated herein by reference.

TECHNICAL FIELD

The present disclosure relates generally to an electromagnetic device and an electromagnetic relay using the same, and more specifically to an electromagnetic device having a movable iron core that moves by magnetic force generated from an excitation coil, and an electromagnetic relay using the same.

BACKGROUND ART

Conventionally, an electromagnetic relay has been known having an electromagnetic device in which a movable element is attracted to a stator by magnetic flux generated at an excitation coil during energization to the excitation coil to move the movable element from a second position to a first position (e.g., see PTL 1). Generally, magnetic flux generated at an excitation coil varies depending on current flowing in the excitation coil.

CITATION LIST

Patent Literature

PTL 1: Unexamined Japanese Patent Publication No. 2015-46377

SUMMARY OF THE INVENTION

An electromagnetic device according to the present disclosure includes an excitation coil, a stator magnetically combined with the excitation coil, a movable element configured to, when current is flown in the excitation coil, be attracted to the stator by magnetic flux generated at the excitation coil to move in a first direction, and move to a position to be in contact with the stator, a yoke having a first end and a second end, and forming a part of a magnetic path for the magnetic flux generated at the excitation coil, and a yoke extension connected to the second end of the yoke and magnetically combined with the yoke, the stator, and the movable element. The first end of the yoke is magnetically combined with the stator, the second end of the yoke is positioned on a side of a second direction that is an opposite direction to the first direction with respect to the movable element, and an end of the yoke extension in the first direction is positioned on a side of the first direction with respect to an end of the stator in the second direction.

An electromagnetic relay of the present disclosure includes the above electromagnetic device and a contact device. The contact device includes a fixed contact and a movable contact, the movable contact moves with a movement of the movable element, the movable contact is in contact with the fixed contact when the movable element is in contact with the stator, the movable contact is away from the fixed contact when the movable element is away from the stator, and the electromagnetic device and the contact device are aligned along the first direction.

DESCRIPTION OF EMBODIMENTS

Before describing exemplary embodiments of the present disclosure, a problem in a conventional device will be briefly described.

In the above described electromagnetic device of PLT 1, when current that flows in an excitation coil fluctuates, there is a possibility that attractive force that attracts a movable element to a stator fluctuates.

Hereinafter, exemplary embodiments of the present disclosure will be described.

First Exemplary Embodiment

Figure 1:
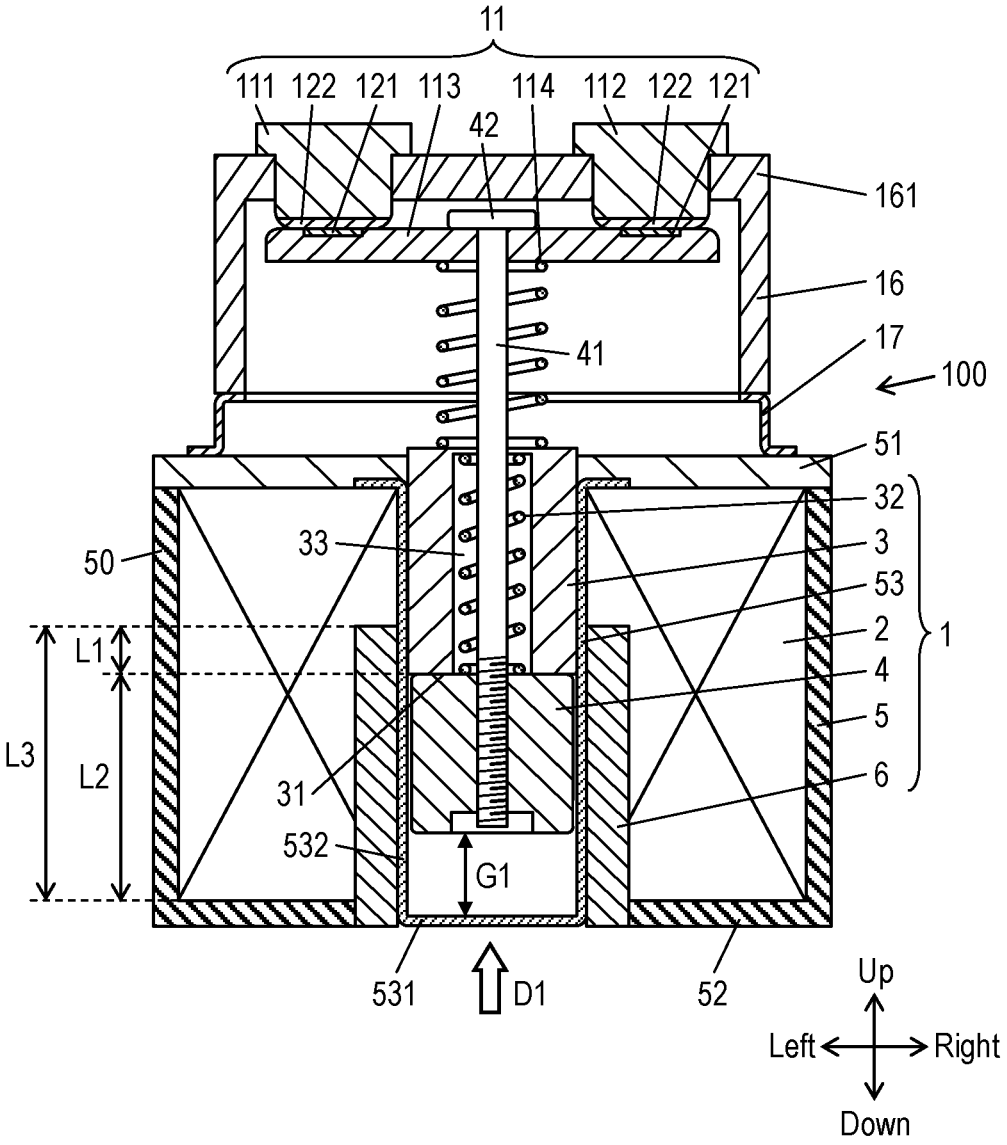
FIG. 1 is a schematic cross-sectional view illustrating an electromagnetic relay according to a first exemplary embodiment.

Electromagnetic device 1 and electromagnetic relay 100 using electromagnetic device 1 according to the exemplary embodiment will be described with reference to FIG. 1, FIG. 2, and FIG. 3. In this regard, electromagnetic relay 100 described below is only an example of the present disclosure, and the present disclosure is not limited to the following embodiments, and besides the exemplary embodiments, various modifications are possible depending on design or the like without departing form the scope of the technical idea of the present disclosure. Furthermore, in the exemplary embodiments, description will be made on the assumption that an arrow in the upper direction in FIG. 1 is defined as an upper direction and an arrow in the right direction in FIG. 1 is defined as a right direction, but the directions are directions determined for the purpose of convenience, so that it is not intended to limit the directions.

Electromagnetic relay 100 of the exemplary embodiment is, for example, mounted on an electric vehicle, and used by being connected with an electrical circuit connecting a traveling battery and a load the electric vehicle. Electromagnetic relay 100 electrically connects or cuts off between the traveling battery and the load to switch supply state of direct current power to the load from the traveling battery depending on a control signal from an Electronic Control Unit (ECU) of the electric vehicle.

First, electromagnetic device 1 will be described. Electromagnetic device 1 includes excitation coil 2, stator 3, movable element 4, yoke 5, and yoke extension 6. Electromagnetic device 1 of the exemplary embodiment further includes return spring 32, and cylindrical body 53. Electromagnetic device 1 attracts movable element 4 to stator 3 by magnetic flux generated at excitation coil 2 during energization to excitation coil 2, and moves movable element 4 from a second position to a first position.

Yoke 5, yoke extension 6, stator 3, and movable element 4 each are formed of a magnetic material, and form a magnetic path for magnetic flux to be generated during energization to excitation coil 2.

Yoke 5 is equipped with yoke upper plate 51 (first end), yoke lower plate 52 (second end), and yoke side plate 50. Yoke 5 is formed of a material such as iron, steel special use stainless (SUS).

Each of yoke upper plate 51 and yoke lower plate 52 is formed in a rectangular plate shape. Yoke upper plate 51 and yoke lower plate 52 are aligned in direction D1, and are disposed in parallel with a surface perpendicular to direction D1. Yoke side plate 50 couples four sides of yoke upper plate 51 and four sides of yoke lower plate 52 corresponding to the respective four sides. Yoke side plate 50 and yoke lower plate 52 of the exemplary embodiment is integrally formed by one plate. Hereinafter, description will be made on the assumption that a center axis direction of excitation coil 2 is up and down direction, a side of yoke upper plate 51 when viewed from excitation coil 2 is an upper direction, and a side of yoke lower plate 52 when viewed from excitation coil 2 is a lower direction, but this does not intend to limit usage modes of electromagnetic relay 100.

In a space surrounded by yoke upper plate 51, yoke lower plate 52, and yoke side plate 50, excitation coil 2, yoke extension 6, cylindrical body 53, and a portion of stator 3 are disposed. Furthermore, in cylindrical body 53, the portion of stator 3 (described above), and movable element 4 are disposed. Excitation coil 2 is disposed between yoke upper plate 51 and yoke lower plate 52 such that its center axis aligns in direction D1 (upper direction).

Cylindrical body 53 is formed in a bottomed cylindrical shape formed of peripheral wall 532 having a cylindrical shape and bottom plate 531 structuring a bottom surface of peripheral wall 532. Cylindrical body 53 is formed by a non-magnetic material. Cylindrical body 53 is disposed so as to have the same axis as the center axis of excitation coil 2. A rim portion of an opening of cylindrical body 53 is fixed to yoke upper plate 51. Bottom plate 531 of cylindrical body 53 is fitted inside yoke extension 6. A portion of peripheral wall 532 is covered with yoke extension 6. A lower end of yoke extension 6 is fitted with a hole of yoke lower plate 52. Furthermore, yoke lower plate 52 is disposed on the opposite side of stator 3 with respect to movable element 4.

Cylindrical body 53 houses stator 3 and movable element 4 inside peripheral wall 532. Movable element 4 is disposed in the lower direction than the lower end surface of stator 3. Each of movable element 4 and stator 3 is disposed to align in direction D1 (upper direction) so as to have the same axis as the center axis of excitation coil 2.

Stator 3 is a fixed iron core. Stator 3 projects in the lower direction from a center portion of a lower surface of yoke upper plate 51, and is formed in a bottomed cylindrical shape opened toward the lower direction. An upper end portion of stator 3 is fitted with a fitting hole formed at a center portion of yoke upper plate 51. Stator 3 is fixed to yoke upper plate 51 so as to have the same axis as the center axis of excitation coil 2. An outer diameter of stator 3 is formed to be smaller than an inner diameter of yoke extension 6 to be described below. A region projecting in the lower direction from a lower end surface of yoke upper plate 51 of stator 3 (a portion of stator 3) is housed in cylindrical body 53.

Stator 3 is formed in a bottomed cylindrical shape opened toward the lower direction. Stator 3 is magnetically coupled to yoke upper plate 51. Stator 3 and yoke 5 of the exemplary embodiment are separately formed. Stator 3 is formed by, for example, electromagnetic stainless steel, magnetic powder body (magnetic powder), ferrite, or the like. In housing space 33 formed around the center axis of stator 3, return spring 32 is housed.

Movable element 4 is a movable iron core. Movable element 4 is formed in a columnar shape. Movable element 4 is formed by, for example, electromagnetic stainless steel, magnetic powder body (magnetic powder), ferrite, or the like. When magnetic powder is used, movable element 4 and stator 3 are formed by mixing a magnetic powder and an insulating material such as a synthetic resin, and by casting and thermally hardening the mixture. At a center portion of movable element 4, a screw hole is formed so as to have the same axis as movable element 4. To the screw hole, shaft 41 having a bar shape to be described below is screwed. Shaft 41 is fixed to movable element 4

Movable element 4 is disposed below stator 3 in a housed state in cylindrical body 53. An upper end surface of movable element 4 is opposed to the lower end surface of stator 3. An outer diameter of movable element 4 is formed to be slightly smaller than the outer diameter of stator 3. Accordingly, the outer diameter of movable element 4 is smaller than the inner diameter of yoke extension 6, enabling movable element 4 to move in the upper direction or the lower direction inside yoke extension 6 along an inner surface of yoke extension 6 For example, movable element 4 is movable along direction D1 in the state where movable element 4 is disposed so as to have the same axis as the center axis of excitation coil 2. Movable element 4 is attracted to stator 3 by magnetic flux F3 generated at excitation coil 2 when current flows in excitation coil 2 to move in direction D1 (upper direction in the exemplary embodiment), and moves to the position at which movable element 4 becomes in contact with stator 3.

Herein, the first position in the exemplary embodiment is a position of movable element 4 in the state where movable element 4 is attracted to stator 3. When movable element 4 is attracted to stator 3, the upper end surface of movable element 4 is in contact with the lower end surface of stator 3. Furthermore, the second position in the exemplary embodiment is the position of movable element 4 in the state where a force of contact pressure spring 114 that biases movable element 4 in the upper direction via shaft 41 and movable contactor 113 and a force of return spring 32 that biases movable element 4 in the lower direction (reverse direction to D1) are balanced. In the state where the force of contact pressure spring 114 and the force of return spring 32 are balanced, the upper end surface of movable element 4 is away from the lower end surface of stator 3. That is, in this state, the upper end surface of movable element 4 is not in contact with the lower end surface of stator 3. Movable element 4 is configured so as to be movable between the first position and the second position.

Hereinafter, the lower end surface of stator 3 to be in contact with movable element 4 (region of stator 3 to be in contact with movable element 4) is referred to as contact face 31.

Return spring 32 is disposed inside stator 3, and is a coil spring that biases movable element 4 in the lower direction. When movable element 4 is at the second position, a lower end of return spring 32 is projected in the lower direction from housing space 33. When movable element 4 is at the first position, return spring 32 is in contact with the upper end surface of movable element 4 to be shrunk by receiving a force in the upper direction from movable element 4, and housed in housing space 33. Consequently, when movable element 4 is at the first position, movable element 4 is in contact with stator 3.

A depth of cylindrical body 53 is set such that a distance between bottom plate 531 and contact face 31 of stator 3 becomes larger than a size of movable element 4 in the up and down direction. Specifically, the depth of cylindrical body 53 is set such that gap length G1 is generated between the lower end surface of movable element 4 and bottom plate 531 of cylindrical body 53 in the state where movable element 4 is in contact with stator 3.

First, as illustrated in FIG. 1, a projecting length of yoke extension 6 from an upper surface of yoke lower plate 52 shall be projecting length L3, a length from the upper surface of yoke lower plate 52 to contact face 31 of stator 3 shall be length L2, and a length from contact face 31 to an upper distal end of yoke extension 6 shall be projecting length L1.

Yoke extension 6 is formed in a cylindrical shape in which its both ends are opened. A lower end of yoke extension 6 is fitted with a fitting hole formed at the center portion of yoke lower plate 52. Yoke extension 6 is fixed to yoke lower plate 52 so as to have the same axis as the center axis of excitation coil 2. That is, yoke extension 6 is provided to yoke lower plate 52. Yoke extension 6 is projected in the upper direction from the upper surface of yoke lower plate 52 along direction D1. Yoke extension 6 is formed to project in direction D1 than contact face 31 of stator 3 from the upper surface of yoke lower plate 52. That is, the length from the upper surface of yoke lower plate 52 to the upper end of yoke extension 6 (projecting length L3) is set larger than the length from the upper surface of yoke lower plate 52 to contact face 31 of stator 3 (length L2). The projecting length of yoke extension 6 in the exemplary embodiment from the upper surface of lower plate 52 (projecting length L3) is set longer by projecting length L1 than length L2. Yoke extension 6 has an overlapping portion overlapping with an outer periphery of stator 3 in the direction perpendicular to direction D1 by projecting in the upper direction from contact face 31 by projecting length L1. Yoke extension 6 is magnetically coupled to stator 3 at the overlapping portion. Furthermore, movable element 4 is disposed inside yoke extension 6 via cylindrical body 53, so that yoke extension 6 is magnetically coupled to movable element 4. That is, yoke extension 6 is magnetically coupled to each of yoke 5, stator 3, and movable element 4.

By the above described configuration, movable element 4 is to be positioned at the second position by the force of return spring 32 because magnetic attractive force is not generated between with stator 3 when excitation coil 2 is not energized (during non-energization). In contrast, when excitation coil 2 is energized, since magnetic attractive force is generated between with stator 3, movable element 4 is pulled in the upper direction against the force of return spring 32 to move to the first position.

In this manner, electromagnetic device 1 controls attractive force acting on movable element 4 by switching the energization state of excitation coil 2 to move movable element 4 in the upper direction or lower direction.

Configuration of Electromagnetic Relay 100

Next, description will be made of electromagnetic relay 100. Electromagnetic relay 100 includes electromagnetic device 1 and contact device 11. Contact device 11 and electromagnetic device 1 are disposed to align in direction D1. Electromagnetic relay 100 of the exemplary embodiment is mounted on, for example, an electric vehicle, and is used by being connected such that contact device 11 is inserted in an electrical circuit connecting a traveling battery and a load of the electric vehicle.

Electromagnetic relay 100 of the exemplary embodiment further includes shaft 41, case 16, coupler 17, and a first input terminal and a second input terminal (not shown) to be connected to an excitation power source. The first input terminal is electrically connected to one end of excitation coil 2, and the second input terminal is electrically connected to the other end of excitation coil 2. The pair of input terminals (first input terminal and second input terminal) is connected to the excitation power source via a switching element that switches between on and off states depending on a control signal from an ECU of the electric vehicle. The ECU of the electric vehicle controls current flowing in excitation coil 2 by switching the switching element to on or off state.

Contact device 11 of the exemplary embodiment includes a pair of fixed contacts 122, a pair of movable contacts 121, a pair of contact bases 111, 112, movable contactor 113, and contact pressure spring 114. The pair of contact bases 111, 112 is formed by a conductive material, and each thereof supports corresponding one of fixed contacts 122. Movable contactor 113 supports the pair of movable contacts 121. Contact pressure spring 114 is provided to secure contact pressure when movable contact 121 is made contact with fixed contact 122. Contact device 11 becomes a closed state in which movable contact 121 is in contact with fixed contact 122 when movable element 4 is in contact with stator 3 by movement of movable contact 121 with movement of movable element 4. Contact device 11 becomes an open state in which movable contact 121 is not in contact with fixed contact 122 when movable element 4 is not in contact with stator 3 by movement of movable contact 121 with movement of movable element 4.

By having the pair of fixed contacts 122 and the pair of movable contacts 121, contact device 11 makes the pair of contact bases 111, 112 be short circuited via movable contactor 113 in the state where contact device 11 is closed. Therefore, contact device 11 is inserted between the traveling battery and the load such that direct current power from the traveling battery is supplied to the load via the pair of contact bases 111, 112 and movable contactor 113.

The pair of contact bases 111, 112 of contact device 11 is disposed to align in a plane perpendicular to direction D1 above electromagnetic device 1. Each of the pair of contact bases 111, 112 is formed in a columnar shape in which its cross-sectional shape in the plane is a circular shape. The pair of contact bases 111, 112 is fixed to case 16 jointed with yoke 5. Case 16 is opened in its lower surface and formed in a box shape having upper plate 161 at its upper surface, and houses fixed contacts 122 and movable contacts 121 between with yoke upper plate 51. Case 16 is formed by, for example, a heatproof material such as a ceramic, and its opening circumference is jointed with a rim of the upper surface of yoke upper plate 51 via coupler 17.

Fixed contact 122 is provided at a lower end of each of the pair of contact bases 111, 112. The pair of contact bases 111, 112 is inserted into respective round holes formed to upper plate 161 of case 16 and jointed with case 16. An upper end of each of the pair of contact bases 111, 112 is exposed toward the upper direction from upper plate 161. A length of the upper end in left and right direction is larger than an outer diameter of each of the pair of contact bases 111, 112 projecting toward the lower direction from upper plate 161.

Case 16, coupler 17, yoke upper plate 51, and cylindrical body 53 in electromagnetic relay 100 of the exemplary embodiment form an airtight container forming an airtight space therein. An arc extinguishing gas having hydrogen as its main element is enclosed in the airtight container. This makes ark be speedy cooled by the arc extinguishing gas even when arc is generated upon shutting off the connection between fixed contact 122 and movable contact 121 housed in the airtight container, making it possible to extinguish the arc speedy. In the exemplary embodiment, the airtight container forming the airtight space therein is formed by case 16, coupler 17, yoke upper plate 51, and cylindrical body 53, but it is not limited that fixed contact 122 and movable contact 121 are housed in an airtight container.

Movable contactor 113 is formed in a rectangular plate shape from a conductive material, and disposed below the pair of contact bases 111, 112 such that both ends thereof in its longitudinal direction are opposed to the lower ends of the pair of contact bases 111, 112. To each region opposed to fixed contact 122 provided in each of contact bases 111, 112 in movable contactor 113, movable contact 121 is provided. At a center portion of movable contactor 113, a hole for passing shaft 41 having a bar shape therethrough is formed. The hole is formed so as to be slightly larger than a size of the shaft 41 in the direction perpendicular to the axis of shaft 41. Consequently, shaft 41 is freely movable in the up and down direction with respect to movable contactor 113.

Movable contactor 113 moves in the upper direction or the lower direction with movement of movable element 4. This makes each movable contact 121 provided on movable contactor 113 move between a state of being in contact with corresponding fixed contact 122 (hereinafter, referred to as closed position) and a state of being away from corresponding fixed contact 122 (hereinafter, referred to as opened position). When movable contact 121 is at the closed position, that is, in the state where contact device 11 is in a closed state, contact base 111 and contact base 112 are short circuited via movable contactor 113. In the state where contact device 11 is in a closed state, direct current power is supplied to the traveling battery to the load of the electric vehicle. In the exemplary embodiment, although movable contacts 121 and movable contactor 113 are separately formed, movable contacts 121 and movable contactor 113 may be integrally formed.

Contact pressure spring 114 is disposed between stator 3 and movable contactor 113, and is a coil spring that biases movable contactor 113 in the upper direction. A force of contact pressure spring 114 is set smaller than a force of return spring 32.

Shaft 41 is formed in a bar shape by a non-magnetic material. Shaft 41 makes movable contactor 113 be in a movable state with movement of movable element 4. At an upper end of shaft 41, flange 42 is formed overlapping with a circumference of the hole of movable contactor 113 through which shaft 41 is passed. A lower end of shaft 41 is fixed to movable element 4 in the state where shaft 41 is passed inside contact pressure spring 114, stator 3, and return spring 32.

Operation of Electromagnetic Relay 100

Next, operation of electromagnetic relay 100 will be described. FIG. 1 illustrated a state of electromagnetic relay 100 during energization to excitation coil 2. When movable element 4 moves to the first position form the second position, flange 42 of shaft 41 moves in the upper direction. Movable contactor 113 is pushed by contact pressure spring 114 to move in the upper direction, and the pair of movable contacts 121 is made contact with the pair of fixed contacts 122. In this context, after movable contact 121 is made contact with fixed contact 122, shaft 41 is further pushed up. Movable contactor 113 is biased in the upper direction by contact pressure spring 114, making it possible to secure contact pressure between the pair of movable contacts 121 and the pair of fixed contacts 122. In this state (state of FIG. 1), since contact device 11 is in a closed state, the pair of contact bases 111, 112 are conducted.

In contrast, during non-energization to excitation coil 2, when movable element 4 moves to the second position from the first position, flange 42 of shaft 41 moves in the lower direction. Movable contactor 113 is pushed down and moved in the lower direction by flange 42, and movable contact 121 and fixed contact 122 are away from each other. When movable element 4 is in the second position, the force of contact pressure spring 114 and the force of return spring 32 are balanced. In this context, movable contactor 113 is in the state of being pushed down in the lower direction by flange 42 of shaft 41 (direction to come close to stator 3). Therefore, movable contactor 113 is regulated in its movement in the upper direction by flange 42 of shaft 41. The pair of movable contacts 121 becomes in a state of being not in contact with the respective pair of fixed contacts 122. In this state, since contact device 11 is in an open state, the pair of contact bases 111, 112 is not conducted.

As described above, electromagnetic relay 100 makes it possible to switch supplying state of direct current power from the traveling battery to the load by moving movable element 4 of electromagnetic device 1 depending on a control signal from the ECU of the electric vehicle to close or open contact device 11.

Projecting length L3 of yoke extension 6 is formed so as to be larger by projecting length L1 than length L2 from contact face 31 of stator 3 to be in contact with movable element 4 to the upper surface of yoke lower plate 52. Hereinafter, effects of yoke extension 6 will be described with reference to FIG. 2 and FIG. 3.

Figure 2:
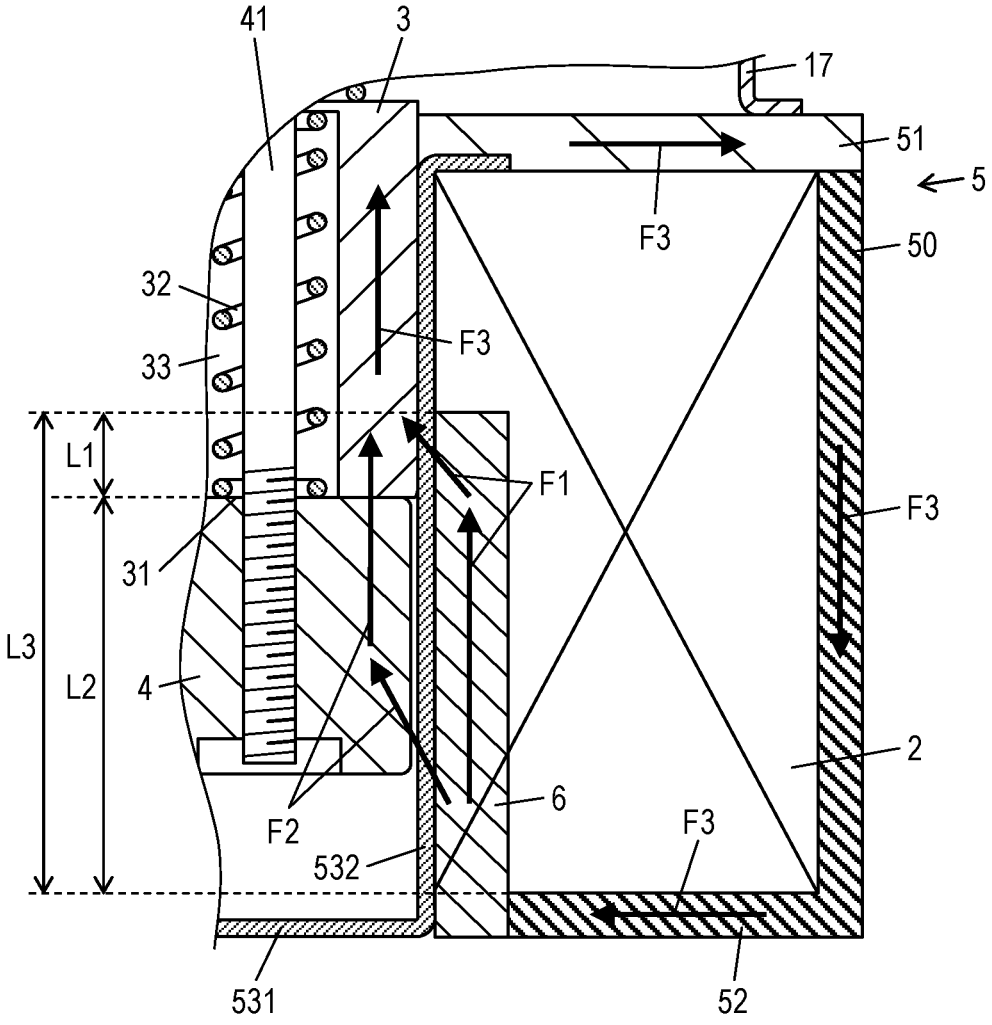
FIG. 2 is a main portion cross-sectional view illustrating magnetic flux passing through the electromagnetic device according to the first exemplary embodiment.

FIG. 2 is a diagram schematically illustrating magnetic fluxes F1 to F3 generated by excitation coil 2 when current flows in excitation coil 2 from the excitation power source. In FIG. 2, movable element 4 is at the first position and in contact with contact face 31 of stator 3.

Magnetic flux F3 passes through yoke upper plate 51, yoke side plate 50, and yoke lower plate 52. Magnetic flux F1 that is some of magnetic flux F3 passes through yoke extension 6, and magnetic flux F2 that is magnetic flux other than magnetic flux F1 among magnetic flux F3 passes through movable element 4. Since magnetic flux F1 and magnetic flux F2 pass through stator 3, magnetic flux F3 passes through stator 3. In this manner, magnetic flux F3 passes through a magnetic path formed by yoke 5, yoke extension 6, movable element 4, and stator 3. Since each of magnetic flux F1 and magnetic flux F2 passes through yoke 5, the magnetic flux that passes through yoke 5 is illustrated in the drawing as magnetic flux F3 synthesizing magnetic flux F1 and magnetic flux F2.

At movable element 4, a magnetic path formed by yoke lower plate 52, yoke extension 6, and stator 3, and a magnetic path formed by yoke lower plate 52, yoke extension 6, movable element 4, and stator 3 are formed. Hereinafter, the magnetic path formed by yoke lower plate 52, yoke extension 6, and stator 3 is referred to as a first magnetic path. The magnetic path formed by yoke lower plate 52, yoke extension 6, movable element 4, and stator 3 is referred to as a second magnetic path.

The inner surface of yoke extension 6 and the outer surface of stator 3 are disposed to overlap by projecting length L1 in the direction perpendicular to direction D1. Consequently, a magnetic resistance of the first magnetic path becomes small as compared with the case where the inner surface of yoke extension 6 and the outer surface of stator 3 are not overlapped in the direction perpendicular to direction D1. As compared with the case where the inner surface of yoke extension 6 and the outer surface of stator 3 are not overlapped in the direction perpendicular to direction D1, the rate of magnetic flux F1 among magnetic flux F3 becomes large, so that stator 3 readily becomes in a magnetic saturation state by magnetic flux F1. When stator 3 becomes a magnetic saturation state, fluctuation of magnitude of magnetic flux F2 is suppressed.

Next, a state where movable element 4 is slightly away from contact face 31, that is the case where movable element 4 is at a position between the first position and the second position and a position near to the first position will be described. The position of movable element 4 in this case is referred to as an intermediate position. For example, in the case where the inner surface of yoke extension 6 and the outer surface of stator 3 are not overlapped in the direction perpendicular to direction D1, the magnitude of magnetic flux F2 fluctuates between when movable element 4 is at the intermediate position and when movable element 4 is at the first position. In the exemplary embodiment, the inner surface of yoke extension 6 and the outer surface of stator 3 are overlapped in the direction perpendicular to direction D1, so that even when movable element 4 is at the intermediate position, the magnitude of magnetic flux F1 among magnetic flux F3 is not so much changed. That is, even when movable element 4 is at the intermediate position, a magnetic saturation state of stator 3 is maintained by magnetic flux F1, so that fluctuation of the magnitude of magnetic flux F2 is suppressed.

Figure 3:
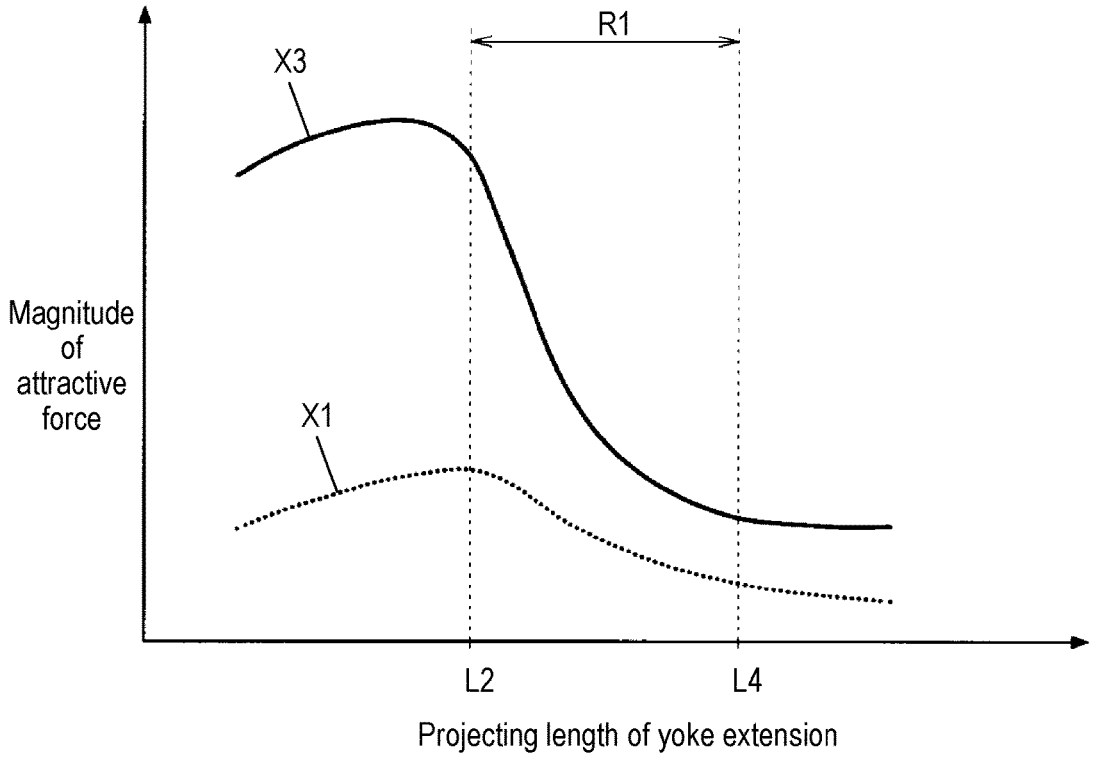
FIG. 3 is a graph illustrating a relation between a projecting length of a yoke extension and magnitude of attractive force according to the first exemplary embodiment.

A graph illustrated in FIG. 3 is an analyzed result of attractive force by which stator 3 attracts movable element 4 in the case where movable element 4 is at the first position at which movable element 4 is in contact with stator 3. A vertical axis in the graph of FIG. 3 denotes attractive force by which stator 3 attracts movable element 4. In other words, the vertical axis denotes attractive force by which movable element 4 positioned at the first position is attracted to stator 3. A lateral axis of the graph illustrated in FIG. 3 is projecting length L3 from the upper surface of yoke lower plate 52 of yoke extension 6. Dotted line X1 illustrates a relation between the magnitude of attractive force that attracts movable element 4 to stator 3 and projecting length L3 of yoke extension 6 in the case where movable element 4 is at the first position when current I1 flows in excitation coil 2. Solid line X3 illustrates a relation between the magnitude of attractive force that attracts movable element 4 to stator 3 and projecting length L3 of yoke extension 6 when current I3 that is approximately three times current I1 flows in excitation coil 2.

Next, an effect of yoke extension 6 in electromagnetic device 1 of the exemplary embodiment will be described. A case will be described as a comparative example of the exemplary embodiment in which projecting length L3 of yoke extension 6 is smaller than length L2 from contact face 31 of stator 3 to be in contact with movable element 4 to the upper surface of yoke lower plate 52. Projecting length L3 of yoke extension 6 in electromagnetic device 1 of the comparative example is smaller than length L2. Therefore, magnetic flux F2 in the comparative example becomes larger than magnetic flux F1 in the comparative example. That is, in electromagnetic device 1 of the comparative example, magnetic flux F2 passing through the second magnetic path becomes larger than magnetic flux F1 passing through the first magnetic path.

In electromagnetic device 1 of the comparative example, the attractive force (attractive force illustrated by solid line X3) in the case where current I3 flows in excitation coil 2 is larger than attractive force (attractive force illustrated by dotted line X1) in the case where current I1 flows in excitation coil 2. Even when projecting length L3 of yoke extension 6 is determined to come close to length L2, the attractive force illustrated by solid line X3 is not less than three times the attractive force illustrated by dotted line X1. That is, in the conventional electromagnetic device 1, the magnitude of the attractive force that attracts movable element 4 to stator 3 is changed depending on change of the magnitude of the current flowing in excitation coil 2.

The cases where current I1, I3 flowing in excitation coil 2 is changed probably include, for example, a case where a surrounding temperature of excitation coil 2 is changed and a case where heat is generated at excitation coil 2 itself by a winding resistance of excitation coil 2. When the magnitude of the attractive force that attracts movable element 4 to stator 3 is changed depending on change of magnitude of current flowing in excitation coil 2, there is a possibility in that loudness of contact noise generated when movable element 4 is moved from the second position to the first position to contact with stator 3 is changed. It has been requested to suppress variation of loudness of the contact noise generated when movable element 4 contacts with stator 3.

On the other hand, the inner surface of yoke extension 6 in the exemplary embodiment is overlapping with the outer surface of stator 3 by projecting length L1 in the direction perpendicular to direction D1. The magnetic resistance of the first magnetic path is smaller than the magnetic resistance of the second magnetic path in electromagnetic device 1 of the exemplary embodiment. Accordingly, even when current I1, I3 flowing in excitation coil 2 is changed to change magnetic flux F3, stator 3 readily becomes in a magnetic saturation state by magnetic flux F1 passing through the first magnetic path, suppressing change of magnetic flux F2.

By magnetic flux F1 passing through the first magnetic path, stator 3 readily becomes in a magnetic saturation state. Specifically, since magnetic flux F1 is larger than magnetic flux F2, when the current flowing in excitation coil 2 becomes large to increase magnetic flux F3, magnetic flux F1 also becomes large and magnetic flux F1 passes through the first magnetic path to readily make stator 3 become in a magnetic saturation state. When the current flowing in excitation coil 2 becomes large to increase magnetic flux F3, magnetic flux F2 also becomes large, but stator 3 is in a magnetic saturation state by magnetic flux F1, so that fluctuation of magnetic flux F2 passing through the second magnetic path is suppressed. Furthermore, even when movable element 4 is at the position (intermediate position) slightly away from the first position, since the magnetic saturation state of stator 3 is held by magnetic flux F1, fluctuation of the magnitude of magnetic flux F2 is suppressed.

In electromagnetic device 1 of the exemplary embodiment, projecting length L3 of yoke extension 6 is set larger than length L2. When projecting length L3 of yoke extension 6 exceeds length L2, attractive force in the case where current I3 flows in excitation coil 2 (attractive force illustrated by solid line X3) is drastically reduced. Specifically, in range R1 in FIG. 3, as projecting length L3 becomes large, solid line X3 is drastically reduced to come close to dotted line X1. Range R1 is a range in which projecting length L3 of yoke extension 6 is not less than length L2, and not more than projecting length L4 in the case where a difference between solid line X3 and dotted line X1 is minimum.

As an area of a face in which the inner surface of yoke extension 6 and the outer surface of stator 3 are opposed by projecting length L1 becomes large, the magnetic resistance between yoke extension 6 and stator 3 becomes small, so that the magnetic resistance of the first magnetic path becomes small. When current I3 larger than current I1 flows in excitation coil 2, magnetic flux F3 becomes large as compared with the case where current I1 flows in, but the magnetic resistance of the first magnetic path is small, so that magnetic flux F1 also becomes large depending on current I3. When magnetic flux F1 becomes large, stator 3 readily becomes in a magnetic saturation state, so that magnetic flux F2 passing through movable element 4 and stator 3 is reduced than that in the comparative example.

In range R1 of FIG. 3, as projecting length L1 of the overlapping portion becomes large, solid line X3 comes close to dotted line X1. That is, as projecting length L3 becomes larger than length L2, the effect of suppressing fluctuation of attractive force that attracts movable element 4 to stator 3 becomes large even when the current flowing in excitation coil 2 becomes large. When projecting length L3 is made further large to exceed range R1, in both cases of solid line X3 and dotted line X1, the attractive force that attracts movable element 4 becomes small gradually. This is probably because stator 3 is in a magnetic saturation state and magnetic flux F1 passing through the first magnetic path becomes large, so that magnetic flux F2 further becomes small.

Since fluctuation of attractive force that attracts movable element 4 to stator 3 is suppressed even when current flowing in excitation coil 2 is fluctuated, variation of the loudness of contact noise generated when movable element 4 is moved from the second position to the first position to contact with stator 3 is suppressed.

As described above, electromagnetic device 1 of the exemplary embodiment includes excitation coil 2, stator 3, movable element 4, yoke 5, and yoke extension 6. Stator 3 is magnetically coupled to excitation coil 2. Movable element 4 is attracted to stator 3 by magnetic flux F3 generated at excitation coil 2 when current flows in excitation coil 2 to move in direction D1, and moves to the position to contact with stator 3. Yoke 5 is magnetically coupled to stator 3 at its first end (yoke upper plate 51 in the exemplary embodiment). Yoke 5 is disposed such that its second end (yoke lower plate 52 in the exemplary embodiment) different from the first end (yoke upper plate 51) is disposed on the opposite side of stator 3 with respect to movable element 4. Yoke 5 forms a portion of the magnetic path for magnetic flux F3 generated at excitation coil 2. Yoke extension 6 is provided at the second end (yoke lower plate 52) of yoke 5, and magnetically coupled to each of yoke 5, stator 3, and movable element 4. Yoke extension 6 is formed to project in direction D1 more than the region of stator 3 to be in contact with movable element 4 (contact face 31 in the exemplary embodiment).

That is, electromagnetic device 1 of the exemplary embodiment includes excitation coil 2, stator 3 magnetically coupled to excitation coil 2, and movable element 4 that is attracted to stator 3 by the magnetic flux generated at excitation coil 2 when current flows in excitation coil 2 to move in direction D1 (upper direction) and is moved to the position to contact with stator 3. Electromagnetic device 1 of the exemplary embodiment includes yoke 5 including the first end (yoke upper plate 51) and the second end (yoke lower plate 52) and forms a portion of the magnetic path for magnetic flux generated at excitation coil 2, and yoke extension 6 that is connected to the second end of yoke 5 (yoke lower plate 52) and magnetically coupled to yoke 5, stator 3, and movable element 4. Furthermore, the first end (yoke upper plate 51) of yoke 5 is magnetically coupled to stator 3 The second end (yoke lower plate 52) of yoke 5 is positioned on the side of the second direction (lower direction in the exemplary embodiment) that is the opposite direction to direction D1 (upper direction in the exemplary embodiment) with respect to movable element 4. End 64 of yoke extension 6 in direction D1 (upper direction) is positioned on the side of the first direction (D1 direction) with respect to an end (contact face 31) of stator 3 in the second direction (lower direction).

According to the above configuration, the second end (yoke lower plate 52) of yoke 5 is disposed on the opposite side of stator 3 with respect to movable element 4, and yoke extension 6 is provided at the second end of yoke 5. Yoke extension 6 is formed to project in direction D1 more than the region (contact face 31) of stator 3 to be in contact with movable element 4. Yoke extension 6 magnetically combines stator 3 with the second end of yoke 5 to form a magnetic path (first magnetic path in the exemplary embodiment) formed by stator 3, yoke 5, and yoke extension 6. Even when current flowing in excitation coil 2 is fluctuated and magnetic flux F3 generated at excitation coil 2 is fluctuated, most of a fluctuation portion of magnetic flux F3 passes through the magnetic path (first magnetic path) formed by stator 3, yoke 5, and yoke extension 6. Consequently, a fluctuation portion of magnetic flux F3 in the magnetic path (second magnetic path in the exemplary embodiment) formed by yoke extension 6 and movable element 4 becomes relatively small. That is, even when the current flowing in the excitation coil 2 is fluctuated, the fluctuation of attractive force that attracts movable element 4 to stator 3 is suppressed. In other words, electromagnetic device 1 makes it possible to suppress fluctuation of the attractive force that attracts movable element 4 to stator 3 even when current flowing in excitation coil 2 is fluctuated.

Electromagnetic device 1 according of the exemplary embodiment makes it possible to suppress fluctuation of attractive force that attracts movable element 4 to stator 3 even when current flowing in excitation coil 2 is fluctuated, making it possible to suppress variation of loudness of contact noise generated when movable element 4 is made contact with contact face 31 of stator 3.

In electromagnetic device 1 of the exemplary embodiment, it is preferable that stator 3 be formed separately from yoke 5.

The above configuration makes it possible to form stator 3 with a material different form that of yoke 5 by separately forming stator 3 and yoke 5.

Electromagnetic relay 100 of the exemplary embodiment includes electromagnetic device 1 (described above) and contact device 11. Contact device 11 includes fixed contact 122 and movable contact 121, and becomes in a closed state in which movable contact 121 is in contact with fixed contact 122 when movable element 4 is in contact with stator 3 by movement of movable contact 121 with movement of movable element 4. Contact device 11 becomes an open state in which movable contact 121 is not in contact with fixed contact 122 when movable element 4 is not in contact with stator 3 by movement of movable contact 121 with movement of movable element 4. Electromagnetic device 1 and contact device 11 are aligned in direction D1.

In other words, electromagnetic relay 100 of the exemplary embodiment includes electromagnetic device 1 (described above) and contact device 11. Contact device 11 includes fixed contact 122 and movable contact 121. Movable contact 121 moves with movement of movable element 4.

When movable element 4 is in contact with stator 3, movable contact 121 is in contact with fixed contact 122, and when movable element 4 is away from stator 3, movable contact 121 is away from fixed contact 122. Electromagnetic device 1 and contact device 11 are aligned in direction D1.

The above configuration makes it possible to provide electromagnetic relay 100 capable of suppressing fluctuation of attractive force that attracts movable element 4 to stator 3 even when current flowing in excitation coil 2 is fluctuated.

Electromagnetic relay 100 of the exemplary embodiment makes it possible to suppress variation of loudness of contact noise generated when movable element 4 is made contact with stator 3 when contact device 11 is switched from an open state to a closed state.

Although each of yoke extension 6, stator 3, and movable element 4 of the exemplary embodiment is formed in a cylindrical shape, each of them may be formed in a square tube shape. Furthermore, yoke extension 6 is not limited to be formed in a cylindrical shape surrounding across the entire periphery of the circumference of the outer surface of stator 3, and may be formed to have a portion overlapping with the outer surface of stator 3 (overlapping portion) in the direction perpendicular to direction D1. For example, yoke extension 6 may include a projection portion at the upper end of a peripheral wall and be formed such that the size from the upper surface of yoke lower plate 52 to the distal end of the projecting portion is larger than length L2. In this case, by overlapping of the projection portion with a portion of the outer surface of stator 3 in the direction perpendicular to direction D1, yoke extension 6 is magnetically coupled to stator 3 and yoke 5. That is, yoke extension 6 may have any shape that enables stator 3 and yoke 5 to be magnetically coupled to yoke extension 6 by being formed such that projecting length L3 from the upper surface of yoke lower plate 52 is formed to be larger than length L2.

Although contact face 31 of the exemplary embodiment is formed so as to be in parallel with a plane perpendicular to direction D1, the region of stator 3 to be in contact with movable element 4 is not limited to a plane perpendicular to direction D1. A region of stator 3 to be in contact with movable element 4 may have a tapered shape in which its outer diameter becomes small toward the direction oriented from movable element 4 to stator 3, or movable element 4 and stator 3 may be in contact with each other at a surface having irregularities. In this case, at the region of stator 3 to be in contact with movable element 4, a length from a region close to the upper surface of yoke lower plate 52 to the upper surface of movable element 4 (contact face 31) becomes length L2. The region of stator 3 to be in contact with movable element 4 may have an appropriate shape such as a plane or a curved surface. Yoke extension 6 only needs to be formed such that projecting length L3 from the upper surface of yoke lower plate 52 becomes larger than length L2.

Since yoke extension 6 and yoke lower plate 52 of the exemplary embodiment are separately formed, yoke extension 6 and yoke lower plate 52 may be integrally formed. Integrally forming yoke extension 6 and yoke lower plate 52 makes it possible to eliminate labor hour to fit yoke extension 6 with the hole of yoke lower plate 52 as well as makes it possible to reduce the number of components of electromagnetic device 1.

Although movable element 4 of the exemplary embodiment is configured to be movable to the first position and the second position, movable element 4 may be configured to be movable in further lower direction than the second position.

Electromagnetic device 1 may have a coil bobbin that is made of a synthetic resin around which excitation coil 2 is wound.

Although contact device 11 of the exemplary embodiment includes the pair of fixed contacts 122 and the pair of movable contacts 121 corresponding to the respective pair of fixed contacts 122, for example, contact device 11 may include, for example, one fixed contact and one movable contact corresponding thereto. In this case, contact device 11 needs to be configured such that its open and closed states are switched by making one fixed contact and one movable contact be switched between a contact state and a non-contact state by movement of movable element 4.

Figure 4:
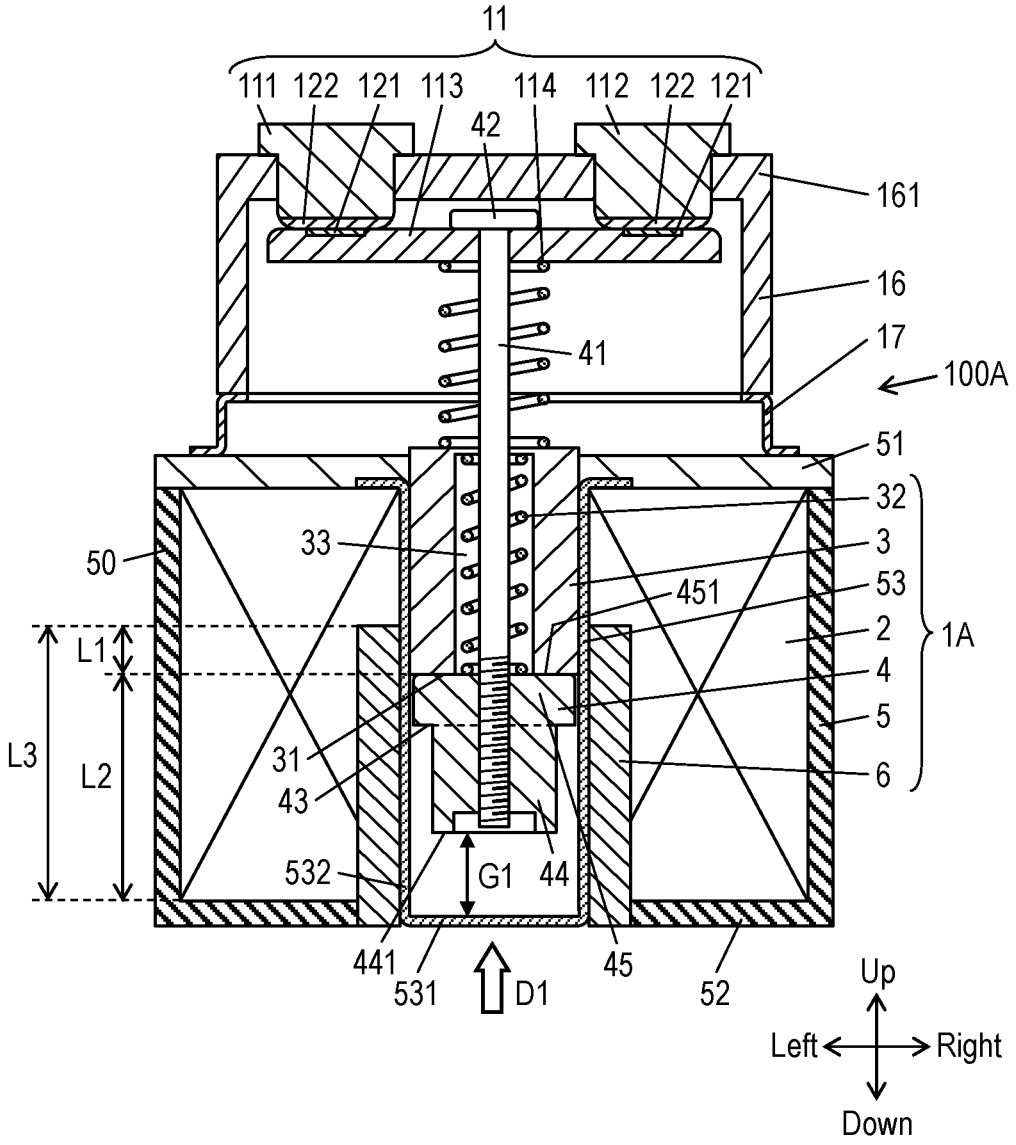
FIG. 4 is a schematic cross-sectional view illustrating an electromagnetic relay according to a first modification of the first exemplary embodiment.

Incidentally, fluctuation of magnetic flux F2 passing through the second magnetic path may be reduced by increasing the magnetic resistance of the second magnetic path by providing a gap between movable element 4 and yoke extension 6. Hereinafter, as illustrated in FIG. 4, electromagnetic device 1A in which step portion 43 is provided in movable element 4 will be described as a first modification of the first exemplary embodiment.

First Modification of First Exemplary Embodiment

Electromagnetic device 1A and electromagnetic relay 100A using the same according to the present modification will be described with reference to FIG. 4.

Electromagnetic device 1A differs from electromagnetic device 1 according to the first exemplary embodiment in that step portion 43 is provided on the outer surface of movable element 4. Step portion 43 is formed such that an outer diameter at its lower end surface is formed to be smaller than an outer diameter at its upper end surface of movable element 4. Furthermore, the size along direction D1 of step portion 43 is set smaller than the size along direction D1 of movable element 4. This makes movable element 4 include contact portion 45 having an outer diameter slightly smaller than the outer diameter of stator 3, and non-contact portion 44 formed to have an outer meter smaller than the outer diameter of stator 3. Contact portion 45 includes upper end surface 451 to be in contact with stator 3 in movable element 4. Non-contact portion 44 includes lower end surface 441 on the opposite side of stator 3 in movable element 4. That is, movable element 4 is formed of two cylindrical bodies that are contact portion 45 to be in contact with contact face 31 of stator 3, and non-contact portion 44 having an outer diameter smaller than that of contact portion 45.

Step portion 43 is provided such that a distance from an outer surface of non-contact portion 44 to the inner surface of cylindrical body 53 is constant. Consequently, the distance from the outer surface of non-contact portion 44 to the inner surface of yoke extension 6 is constant.

Non-contact portion 44 is formed in a cylindrical shape to have the same axis as the center axis of excitation coil 2. The outer diameter of contact portion 45 on the upper side of non-contact portion 44 in movable element 4 is formed to be slightly smaller than the outer diameter of stator 3.

By providing step portion 43 to movable element 4, a magnetic resistance of a magnetic path formed by non-contact portion 44 and yoke extension 6 becomes larger than that in the case of movable element 4 being provided with no step portion 43. That is, it is possible to increase the magnetic resistance of the second magnetic path formed by movable element 4 and yoke extension 6 When the magnetic resistance of the second magnetic path becomes large, the magnetic resistance of the first magnetic path becomes relatively small, which causes magnetic flux F3 generated at excitation coil 2 to readily pass through the first magnetic path formed by yoke extension 6 and stator 3, readily increasing magnetic flux F1 (see FIG. 2). When magnetic flux F1 becomes large, stator 3 readily becomes in a magnetic saturation state, suppressing fluctuation of magnetic flux F2 passing through the second magnetic path when current flowing in excitation coil 2 is fluctuated.

As described above, movable element 4 of electromagnetic device 1A according to the first modification of the first exemplary embodiment includes contact portion 45 to be in contact with stator 3, and non-contact portion 44 on the opposite side of stator 3 with respect to contact portion 45. In movable element 4, it is preferable that the distance from non-contact portion 44 to yoke extension 6 be larger than the distance from contact portion 45 to yoke extension 6 in a direction perpendicular to direction D1. In the present modification, by providing step portion 43 in movable element 4, the distance from the outer surface of non-contact portion 44 to the inner surface of yoke extension 6 is larger than the distance from contact portion 45 to the inner surface of yoke extension 6.

In other word, movable element 4 includes contact portion 45 to be in contact with stator 3, and non-contact portion 44 to be not in contact with stator 3, and the distance from the outer surface of non-contact portion 44 to the inner surface of yoke extension 6 is larger than the distance from the outer surface of contact portion 45 to the inner surface of yoke extension 6 in a third direction (left and right direction) perpendicular to direction D1 (upper direction).

According to the above configuration, the distance from non-contact portion 44 to yoke extension 6 is larger than the distance from contact portion 45 to yoke extension 6, making it possible to increase the magnetic resistance of the magnetic path formed by non-contact portion 44 and yoke extension 6. That is, the above configuration makes it possible to increase the magnetic resistance of the second magnetic path as compared with the case where the distance from non-contact portion 44 to yoke extension 6 is identical to the distance from contact portion 45 to yoke extension 6. When the magnetic resistance of the second magnetic path becomes large, the magnetic resistance of the first magnetic path becomes relatively small, which causes magnetic flux F3 generated at excitation coil 2 to readily pass through the first magnetic path formed by yoke extension 6 and stator 3, readily increasing magnetic flux F1 (see FIG. 2). When magnetic flux F1 becomes large, stator 3 readily becomes in a magnetic saturation state, suppressing fluctuation of magnetic flux F2 passing through the second magnetic path when current flowing in excitation coil 2 is fluctuated. This suppresses fluctuation of attractive force generated to movable element 4.

Figure 5:
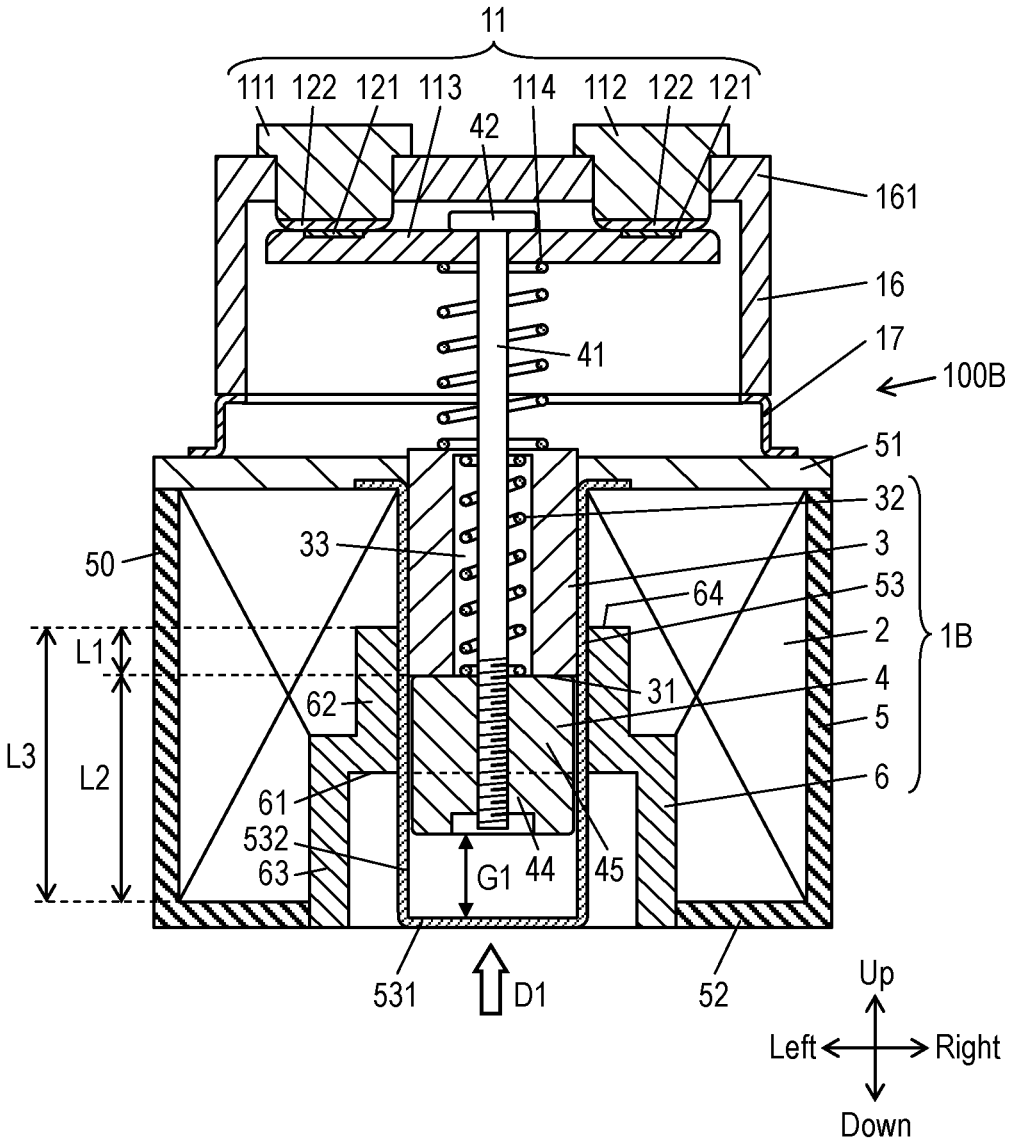
FIG. 5 is a schematic cross-sectional view illustrating an electromagnetic relay according to a second modification of the first exemplary embodiment.

Like the first modification of the first exemplary embodiment, instead of increasing the magnetic resistance between movable element 4 and yoke extension 6 by reducing the outer diameter of movable element 4, the magnetic resistance of the second magnetic path may be increased by increasing the diameter of yoke extension 6. Hereinafter, as illustrated in FIG. 5, electromagnetic device 1B and electromagnetic relay 100B using the same equipped with step portion 61 at yoke extension 6 will be described as a second modification of the exemplary embodiment.

Second Modification of First Exemplary Embodiment

Movable element 4 of the present modification differs from the first modification in that the outer diameter of non-contact portion 44 is the same as the outer diameter of contact portion 45. The other configurations of non-contact portion 44 and contact portion 45 are the same as those in the first modification.

Electromagnetic device 1B differs from electromagnetic device 1 of the first exemplary embodiment in that step portion 61 is provided in an inner surface of yoke extension 6. Step portion 61 is formed such that an inner diameter at a lower end of yoke extension 6 is larger than an outer diameter of an upper end of yoke extension 6. Furthermore, a length along direction D1 from a lower surface of step portion 61 to the upper surface of yoke lower plate 52 is set smaller than projecting length L3 of yoke extension 6. This makes yoke extension 6 have small diameter portion 62 having an inner diameter slightly larger than the outer diameter of stator 3, and large diameter portion 63 formed to have an inner diameter larger than the outer diameter of stator 3. That is, yoke extension 6 is formed of two hollow cylindrical bodies having different inner diameters.

Step portion 61 is provided such that a distance from an inner surface of large diameter portion 63 to an outer surface of cylindrical body 53 is constant. Accordingly, the inner surface of large diameter portion 63 is formed such that a distance from an inner surface of large diameter portion 63 to the outer surface of movable element 4 is constant.

Large diameter portion 63 is formed in a cylindrical shape to have the same axis as the center axis of excitation coil 2. In yoke extension 6, an inner diameter of large diameter portion 63 is formed to be larger than an outer diameter of small diameter portion 62 on the upper side of large diameter portion 63.

By providing step portion 61 in yoke extension 6, a magnetic resistance of a magnetic path formed by large diameter portion 63 and movable element 4 becomes larger than that in the case where no step portion 61 is provided in yoke extension 6. That is, it is possible to increase the magnetic resistance of the second magnetic path formed by movable element 4 and yoke extension 6 When the magnetic resistance of the second magnetic path becomes large, the magnetic resistance of the first magnetic path becomes relatively small, which causes magnetic flux F3 generated at excitation coil 2 to readily pass through the first magnetic path formed by yoke extension 6 and stator 3, readily increasing magnetic flux F1 (see FIG. 2). When magnetic flux F1 becomes large, stator 3 readily becomes in a magnetic saturation state, suppressing fluctuation of magnetic flux F2 passing through the second magnetic path when current flowing in excitation coil 2 is fluctuated. This suppresses fluctuation of attractive force generated to movable element 4.

As described above, movable element 4 of electromagnetic device 1B according to the present modification includes contact portion 45 to be in contact with stator 3, and non-contact portion 44 on the opposite side of stator 3 with respect to contact portion 45. In movable element 4, it is preferable that the distance from non-contact portion 44 to large diameter portion 63 (yoke extension 6) be larger than the distance from contact portion 45 to small diameter portion 62 (yoke extension 6) in the direction perpendicular to direction D1 (left and right direction in the present modification). In the present modification, by providing step portion 61 in yoke extension 6, the distance from the outer surface of non-contact portion 44 to the inner surface of large diameter portion 63 is larger than the distance from contact portion 45 to the inner surface of small diameter portion 62.

In other word, like the first modification, in the second modification, movable element 4 includes contact portion 45 to be in contact with stator 3, and non-contact portion 44 to be not in contact with stator 3, and the distance from the outer surface of non-contact portion 44 to the inner surface of yoke extension 6 is larger than the distance from the outer surface of contact portion 45 to the inner surface of yoke extension 6 in the third direction (left and right direction) perpendicular to direction D1 (up and down direction).

According to the above configuration, the distance from the non-contact portion 44 to large diameter portion 63 (yoke extension 6) is larger than the distance from contact portion 45 to small diameter portion 62 (yoke extension 6), making it possible to increase the magnetic resistance of the magnetic path formed by non-contact portion 44 and yoke extension 6. That is, the above configuration makes it possible to increase the magnetic resistance of the second magnetic path as compared with the case where the distance from non-contact portion 44 to yoke extension 6 is identical to the distance from contact portion 45 to yoke extension 6. Hereinafter, like the first modification, since stator 3 readily becomes in a magnetic saturation state when magnetic flux F1 becomes large, fluctuation of magnetic flux F2 passing through the second magnetic path is suppressed when the current flowing in excitation coil 2 is fluctuated.

Note that, in electromagnetic device 1 of the first exemplary embodiment 1, both step portion 43 and step portion 61 may be provided. Step portion 43 and step portion 61 make it possible to further increase a magnetic resistance between movable element 4 and yoke extension 6.

Furthermore, a gap may be formed between movable element 4 and yoke extension 6 by peripheral wall 532 of cylindrical body 53 and movable element 4 each having a shape tapered toward the lower direction. Alternatively, for example, the distance between movable element 4 and yoke extension 6 may be increased by disposing a proper member between movable element 4 and yoke extension 6.

Although step portion 43 of the exemplary embodiment is provided such that the distance from the outer surface of non-contact portion 44 to the inner surface of yoke extension 6 becomes constant, but for example, the outer surface of non-contact portion 44 may be provided to form a tapered surface. For example, non-contact portion 44 may be formed in a cylindrical shape having a tapered surface in which its outer diameter becomes large toward its upper end surface from its lower end surface. Alternatively, it is not limited that step portion 43 is provided across the entire outer periphery of movable element 4, and for example, may be formed in a groove shape. That is, step portion 43 needs to be provided to increase the magnetic resistance of the magnetic path formed by yoke extension 6 and movable element 4. To be more specific, step portion 43 may be provided to have an appropriate shape that increases the distance between yoke extension 6 and movable element 4.

Second Exemplary Embodiment

Figure 6:
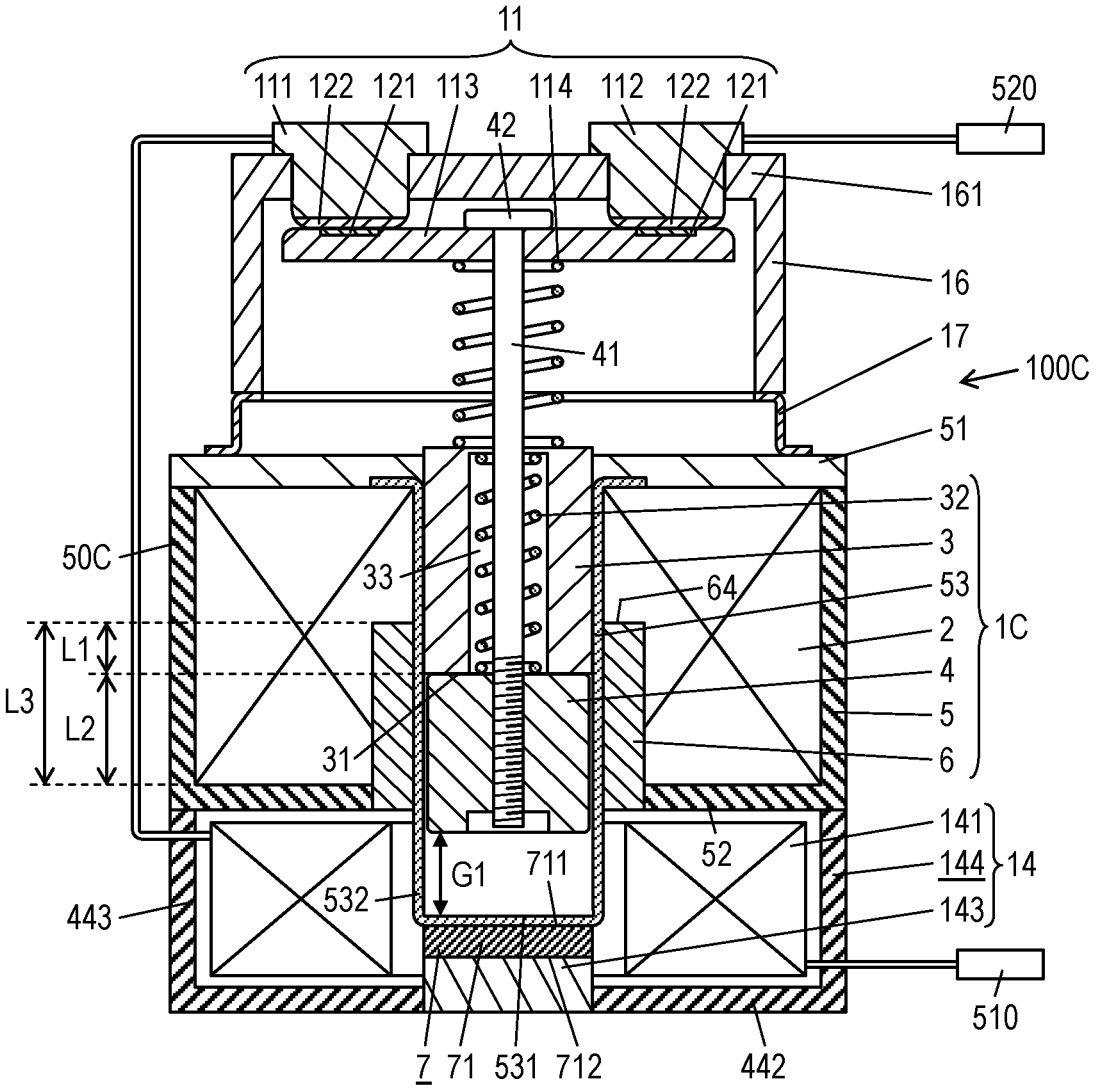
FIG. 6 is a schematic cross-sectional view illustrating an electromagnetic relay according to a second exemplary embodiment.
Figure 7:
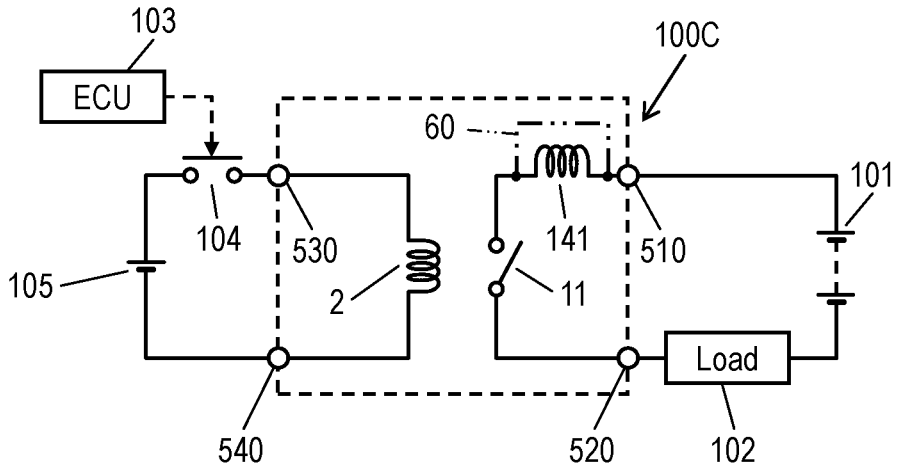
FIG. 7 is a schematic circuit diagram illustrating a connection example of the electromagnetic relay according to the second exemplary embodiment.

Electromagnetic device 1C and electromagnetic relay 100C using the same according to the exemplary embodiment will be described with reference to FIG. 6 and FIG. 7. Note that same reference numerals are attached to the same components as those in electromagnetic device 1 of the first exemplary embodiment, and descriptions thereof will be omitted.

Electromagnetic relay 100C is used, for example, by being mounted on an electric vehicle. As illustrated in FIG. 7, electromagnetic relay 100C is connected such that contact device 11 is inserted on a path for supplying direct current power from traveling battery 101 to load 102. Load 102 is, for example, an inverter or the like. Excitation coil 2 of electromagnetic relay 100C is connected to excitation power source 105 via switching element 104 switched between on and off states depending on a control signal from ECU 103 of the electric vehicle. This enables electromagnetic relay 100C to open and close contact device 11 depending on a control signal from ECU 103 to switch supplying state of direct current power to load 102 from traveling battery 101.

Electromagnetic relay 100C forcibly moves movable element 4 from the first position to a third position by using magnetic flux generated at excitation coil 141 when abnormal current flows, making it possible to speedy detect the generation of abnormal current to quickly cutoff an electrical circuit (contact device 11).

Electromagnetic relay 100C includes electromagnetic device 1C, contact device 11, and trip device 14. As illustrated in FIG. 7, electromagnetic relay 100C further includes a pair of output terminals 510, 520 inserted on the path for supplying direct current power from traveling battery 101 to load 102, and a pair of input terminals 530, 540 to be connected to excitation power source 105.

Contact device 11 includes a pair of fixed contacts 122, a pair of movable contacts 121, a pair of contact bases 111, 112, movable contactor 113, and contact pressure spring 114. Fixed contact 122 is provided at a lower end of each of the pair of contact bases 111, 112. Contact device 11 becomes in an open state where movable contact 121 is not in contact with fixed contact 122 when movable element 4 is not in contact with stator 3 by movement of movable contact 121 with movement of movable element 4.

To contact base 111, output terminal 510 is connected via excitation coil 141. To contact base 112, output terminal 520 is connected. That is, excitation coil 141 is inserted between contact base 111 and output terminal 510.

Electromagnetic device 1C has yoke side plate 50C instead of yoke side plate 50 of electromagnetic device 1 according to the first exemplary embodiment. Both ends of excitation coil 2 are connected to the pair of input terminals 530, 540, respectively. That is, magnetic flux F3 is generated at excitation coil 2 by current flowing through the pair of input terminals 530, 540.

Yoke side plate 50C is formed to be smaller than yoke side plate 50 in its length in the up and down direction, and the distance between yoke upper plate 51 and yoke lower plate 52 becomes smaller than that in electromagnetic device 1. Consequently, cylindrical body 53 projects on the lower side of yoke lower plate 52. Also in this case, projecting length L3 of yoke extension 6 is set larger than length L2 from the upper surface of yoke lower plate 52 to contact face 31 of stator 3. A lower portion of cylindrical body 53 projecting on the lower side of yoke lower plate 52 is fitted with a center portion of trip device 14.

Trip device 14 includes excitation coil 141 connected with contact device 11 in series, and holding device 7. Trip device 14 of the exemplary embodiment further includes stator 143 disposed on the opposite side of stator 3 in direction D1 with respect to movable element 4, and yoke 144. Each of Yoke 144 and stator 143 is formed of a magnetic material. All movable element 4, excitation coil 141, and stator 143 are configured to have center axes on the same straight line along direction D1.

The trip device 14 is disposed to align with contact device 11 and electromagnetic device 1C on the same straight line along direction D1, and is disposed on the opposite side of contact device 11 with respect to electromagnetic device 1C. That is, trip device 14 is disposed on the lower side of electromagnetic device 1C.

Trip device 14 moves movable element 4 to the third position by magnetic flux generated at excitation coil 141 by abnormal current of not less than a defined value flowing through contact device 11 in the state where movable element 4 is positioned at the first position. The third position is positioned further below the second position.

Yoke 144 forms, with stator 143 and movable element 4, a magnetic path through which magnetic flux generated during energization to excitation coil 141 passes. Yoke lower plate 52 and yoke extension 6 of yoke 5 are also used as an upper plate of yoke 144, and yoke 144 is provided with lower plate 442 that is provided below excitation coil 141 and opposed to yoke lower plate 52 of yoke 5. Hereinafter, yoke lower plate 52 and yoke extension 6 also used as the upper plate of yoke 144 will be described as not only parts of yoke 5 but also as a member structuring parts of yoke 144.

Yoke 144 further includes side plate 443 coupling periphery portions of yoke lower plate 52 and lower plate 442. Herein, each of yoke lower plate 52 and lower plate 442 is formed in a rectangular plate shape. Side plate 443 couples four sides of yoke lower plate 52 to four sides of lower plate 442 corresponding to the respective four sides of yoke lower plate 52. Side plates 443 and lower plate 442 in the exemplary embodiment are consecutively and integrally formed by one plate.

Excitation coil 141 is disposed in a space surrounded by yoke 144 (yoke lower plate 52, yoke extension 6, lower plate 442, and side plate 443). A lower end of cylindrical body 53 is disposed inside excitation coil 141. That is, cylindrical body 53 penetrates through yoke lower plate 52 of yoke 5, and its lower end projects inside excitation coil 141.

Excitation coil 141 is connected to contact device 11 in series between the pair of output terminals 510, 520. In the exemplary embodiment, excitation coil 141 is connected between contact base 111 and output terminal 510. This makes excitation coil 141 form a part of the path for load current to be supplied to load 102 from traveling battery 101 in the state where contact device 11 is closed, and excitation coil 141 is excited by the load current. To excitation coil 141 of the exemplary embodiment, bypass route 60 is electrically connected in parallel such that load current is capable of being flown through also another route other than excitation coil 141. By providing bypass route 60, electromagnetic relay 100C enables some of load current to be supplied to load 102 from the traveling battery 101 to flow in bypass route 60, making it possible to suppress loss in excitation coil 141.

Stator 143 is a fixed iron core formed in a columnar shape that is a shape projecting from a center portion of the upper surface of lower plate 442 to the upper direction, and is fixed to yoke 144 by making its lower end be fitted with a hole formed at the center portion of lower plate 442. An outer diameter of stator 143 is formed to be slightly larger than the outer diameter of movable element 4.

Holding device 7 is equipped with holding magnet 71 formed of a permanent magnet. Holding device 7 holds movable element 4 at the third position by magnetic flux generated at holding magnet 71 when movable element 4 is moved to the third position by trip device 14. When trip device 14 is tripped to move movable element 4 to the third position, movable element 4 is held (latched) at the third position by holding device 7.

Holding magnet 71 is disposed on the opposite side of stator 3 with respect to movable element 4 in direction D1 in which stator 3 and movable element 4 are aligned. That is, holding magnet 71 is disposed between stator 143 and bottom plate 531. Holding magnet 71 is disposed such that first pole face 711 that is its upper surface is in contact with bottom plate 531 of cylindrical body 53. Holding magnet 71 is disposed such that second pole face 712 that is its lower surface is in contact with stator 143. That is, holding magnet 71 is aligned on a straight line formed by stator 3 and movable element 4 in direction D1 and disposed on the lower side that is opposite side of stator 3 with respect to stator 4. Holding magnet 71 is formed in a disc shape to have the same axis as the center axis of excitation coil 141. An outer diameter of holding magnet 71 is formed to be substantially the same as the outer diameter of stator 143. Holding magnet 71 includes first pole face 711 and second pole face 712 that are opposite polarity with each other on its both surfaces in direction D1 (upper direction). In the exemplary embodiment, although description is made on the assumption that first pole face 711 is a north pole and second pole face 712 is a south pole, but the north pole and the south pole may have an inverse relationship.

Next, operation of trip device 14 will be described. In trip device 14, stator 143 causes attraction force in the opposite direction of the attraction force that attracts movable element 4 by stator 3 to act on movable element 4 by attracting movable element 4 on the opposite side (lower side) of direction D1 with respective to stator 3 by magnetic flux generated at excitation coil 141. That is, trip device 14 moves movable element 4 to the third position by the magnetic flux generated at excitation coil 141 during energization to excitation coil 141, thus forcibly making contact device 11 be in an open state. Hereinafter, the operation of moving movable element 4 positioned at the first position to the third position performed by trip device 14 is referred to as trip operation. That is, trip device 14 forcibly makes contact device 11 in a close state be in an open state by the trip operation.

The third position is on the extension of a moving axis of movable element 4 connecting the first position and the second position. The third position is a position on the opposite side (lower direction) of the first position in direction D1 with respect to the second position. In other word, the second position is a position between the first position and the third position. In the state where trip device 14 is not tripped, movable element 4 is positioned at the first position during energization to excitation coil 2, and positioned at the second position during non-energization to excitation coil 2.

When trip device 14 is tripped, movable element 4 is positioned at the third position. That is, when trip device 14 is tripped in the state where movable element 4 is at the first position, movable element 4 moves from the first position to the third position via the second position.

Magnetic flux generated at excitation coil 141 passes through a magnetic path formed by yoke 144, stator 143, and movable element 4.

Trip device 14 causes attractive force in the direction to move movable element 4 such that the magnetic resistance of the magnetic path becomes small to act on movable element 4. In other words, trip device 14 causes attractive force in the direction to move movable element 4 from the first position to the third position to act on movable element 4 such that the gap between the upper end surface of stator 143 and the lower end surface of yoke extension 6 in the magnetic circuit is filled with movable element 4.

Electromagnetic relay 100C causes attractive force between movable element 4 and stator 3 to act on movable element 4 in the upper direction in the state where excitation coil 2 is energized and contact device 11 is in a close state (the state where movable element 4 is in the first position). Furthermore, a spring force of return spring 32 and an attractive force between movable element 4 and stator 143 act in the lower direction.

In the state where movable element 4 is in the first position, trip device 14 is tripped when a resultant force of the spring force of return spring 32 and attractive force between movable element 4 and stator 143 exceeds attractive force between movable element 4 and stator 3. By the trip operation, movable element 4 moves from the first position to the third position. The attractive force acting on movable element 4 from stator 143 varies depending on the magnitude of current (load current) flowing in excitation coil 141. Therefore, trip device 14 is configured such that trip operation is performed when current flowing in excitation coil 141 becomes an abnormal current of not less than a defined value. For example, the defined value is set at a value that becomes overcurrent with respect to a rated current of electromagnetic relay 100, or a value that becomes short-circuit current. The overcurrent described herein is, for example, a current having a magnitude of about five to ten times the rated current, and the short-circuit current described herein is, for example, a current having a magnitude of about several dozen times the rated current. Thus, in electromagnetic relay 100, trip device 14 causes movable element 4 to move to the third position to forcibly make contact device 11 be in a close state when abnormal current such as overcurrent and short-circuit current is flown in contact device 11.

Incidentally, when attractive force between movable element 4 and stator 3 is changed, timing of starting the trip operation in trip device 14 is changed. In the case where attractive force between movable element 4 and stator 3 is large, there is a case that trip device 14 fails to perform the trip operation unless current value of current flowing in excitation coil 141 becomes further larger than a defined value. In contrast, in the case where attractive force between movable element 4 and stator 3 is small, there is a case that trip device 14 performs the trip operation even when current value of current flowing in excitation coil 141 is less than a defined value.

Electromagnetic relay 100C of the exemplary embodiment includes electromagnetic device 1C, so that even when magnitude of current flowing in excitation coil 2 of electromagnetic device 1 is fluctuated, the attractive force between movable element 4 and stator 3 is unlikely to fluctuate. Consequently, fluctuation of timing of stating the trip operation in trip device 14 is suppressed. That is, trip device 14 makes it possible to stably perform the trip operation at a timing at which current flowing in excitation coil 141 exceeds a defined value.

Electromagnetic relay 100C is used, for example, by being mounted on an electric vehicle. As illustrated in FIG. 7, electromagnetic relay 100C is connected such that contact device 11 is inserted on a path for supplying direct current power from traveling battery 101 to load 102. Load 102 is, for example, an inverter or the like. Excitation coil 2 of electromagnetic relay 100C is connected to excitation power source 105 via switching element 104 switched between on and off states depending on a control signal from ECU 103 of the electric vehicle. This enables electromagnetic relay 100C to open and close contact device 11 depending on a control signal from ECU 103 to switch supplying state of direct current power to load 102 from traveling battery 101.

As described above, electromagnetic device 1C of the exemplary embodiment includes excitation coil 2, stator 3, movable element 4, yoke 5, and yoke extension 6.

In yoke extension 6, the length of yoke side plate 50 along direction D1 coupling yoke upper plate 51 (first end) and yoke lower plate 52 (second end) is set smaller than the length of cylindrical body 53 along direction D1. Cylindrical body 53 projects from yoke lower plate 52 (second end) in the opposite direction of direction D1. Yoke extension 6 is formed to project in direction D1 more than the region (contact face 31) of stator 3 to be in contact with movable element 4.

With the above configuration, in electromagnetic device 1C, it is possible to suppress fluctuation of attractive force that attracts movable element 4 to stator 3 even when current flowing in excitation coil 2 is fluctuated.

Electromagnetic relay 100C of the exemplary embodiment includes electromagnetic device 1C, contact device 11, and trip device 14. Trip device 14 includes excitation coil 141 connected with contact device 11 in series, and holding device 7. All movable element 4, excitation coil 141, and holding device 7 are configured to have center axes on the same straight line along direction D1. Contact device 11 becomes in an open state where movable contact 121 is not in contact with fixed contact 122 when movable element 4 is not in contact with stator 3 by movement of movable contact 121 with movement of movable element 4. Trip device 14 includes excitation coil 141 connected with contact device 11 in series, and holding device 7. Trip device 14 moves movable element 4 to the third position by magnetic flux generated at excitation coil 141 by abnormal current of not less than a defined value flowing through contact device 11 in the state where movable element 4 is at the first position. The third position is positioned further below the second position.

The above configuration suppresses fluctuation of attractive force that attracts movable element 4 to stator 3 even when current flowing in excitation coil 2 is fluctuated, making it easy to stable the attractive force.

By making the attractive force in direction D1 with respect to movable element 4 stable in the state where movable element 4 is at the first position, the attractive force in the reverse direction to direction D1 that is necessary during moving movable element 4 in the reverse direction to direction D1 becomes stable. This makes trip device 14 easily start the trip operation when a current value of current flowing through contact device 11 reaches a defined value, stabilizing the trip operation.

Electromagnetic relay 100C of the exemplary embodiment has holding device 7 having holding magnet 71 formed of a permanent magnet. Holding device 7 holds movable element 4 at the third position by magnetic flux generated at holding magnet 71 when movable element 4 is moved to the third position by trip device 14. When trip device 14 is operated (tripped), holding device 7 holds movable element 4 at the third position by magnetic flux generated at holding magnet 71 even when energization to excitation coil 141 is stopped later. This enables electromagnetic relay 100C to make contact device 11 hold its open state when abnormal current is flown in contact device 11.

Note that trip device 14 in electromagnetic relay 100C according to the exemplary embodiment may have an appropriate configuration that attracts movable element 4 on the opposite side of stator 3 by attractive force generated at excitation coil 141. For example, the direction of magnetic flux generated at excitation coil 141 may be the same direction as the direction of magnetic flux generated at excitation coil 2, or may be the reverse direction. When the direction of the magnetic flux generated at excitation coil 141 is the reverse direction to the direction of the magnetic flux generated at excitation coil 2, trip device 14 cancels the magnetic flux generated at movable element 4. Trip device 14 performs the trip operation by moving movable element 4 to the third position by the spring force of return spring 32 and the attractive force generated by the magnetic flux of the holding magnet. In contrast, when the direction of the magnetic flux generated at excitation coil 141 is the same direction as the direction of the magnetic flux generated at excitation coil 2, trip device 14 performs the trip operation by attracting movable element 4 to stator 143 by the attractive force larger than the attractive force that attracts movable element 4 by stator 3.

Although being inserted between a positive electrode (plus electrode) of battery 101 and load 102, contact device 11 of the exemplary embodiment may be inserted between a negative electrode (minus electrode) of battery 101 and load 102.

Note that trip device 14 of the exemplary embodiment is applicable to each of the first exemplary embodiment, the first modification of the first exemplary embodiment, and the second modification of the first exemplary embodiment.

Third Exemplary Embodiment

Next, electromagnetic device 1D and electromagnetic relay 100D using the same according to the exemplary embodiment will be described with reference to FIG. 8. Note that same reference numerals are attached to the same components as those in electromagnetic device 1 of the first exemplary embodiment, and descriptions thereof will be omitted.

Figure 8:
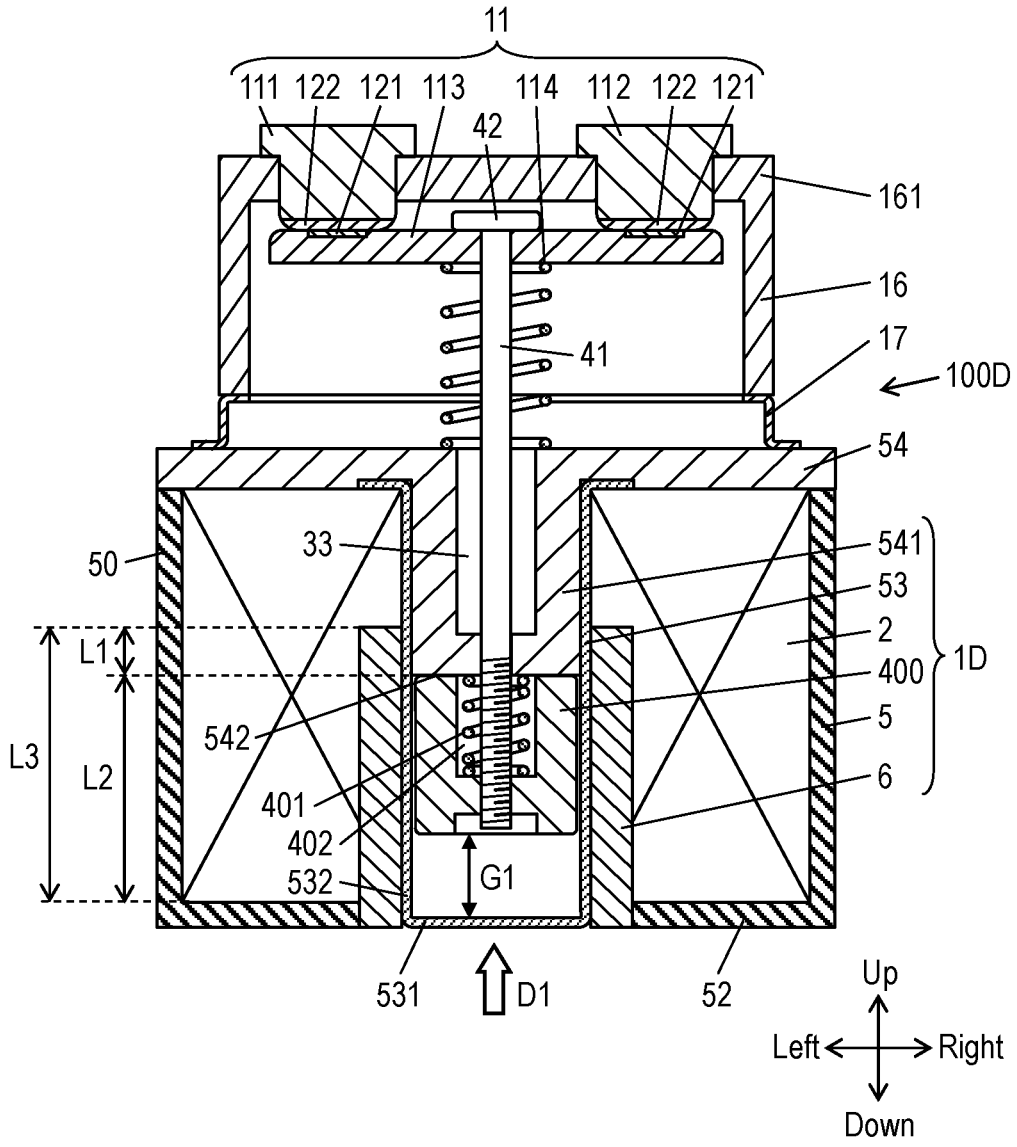
FIG. 8 is a schematic cross-sectional view illustrating an electromagnetic relay according to a third exemplary embodiment.

Incidentally, it is not limited that yoke upper plate 51 and stator 3 are separately formed as illustrated in FIG. 1, and yoke upper plate 51 and stator 3 may be integrally formed as illustrated in FIG. 8. Electromagnetic device 1D of the exemplary embodiment illustrated in FIG. 8 includes yoke upper plate 54 integrally formed with stator 541 instead of yoke upper plate 51 and stator 3 in electromagnetic device 1. Electromagnetic device 1D further includes movable element 400 and return spring 401 instead of movable element 4 and return spring 32 of electromagnetic device 1.

Yoke upper plate 54 is formed in a rectangular plate shape, and stator 541 is formed at its center portion. Other structure of yoke upper plate 54 is same as that of yoke upper plate 51, so that description thereof will be omitted.

Stator 541 is formed in a bottomed cylindrical shape projecting in the lower direction from a center portion of a lower surface of yoke upper plate 54. Stator 541 is formed to project in the lower direction from yoke upper plate 54. Stator 541 is formed to have the same axis as the center axis of excitation coil 2. An outer diameter of stator 541 is formed to be the substantially same size as the outer diameter of stator 3 of the first exemplary embodiment. A region projecting in the lower direction from a lower surface of yoke upper plate 54 in stator 541 (portion of stator 541) is housed in cylindrical body 53. A hole to have the same axis as the center axis of excitation coil 2 is formed in the lower surface of stator 541. Shaft 41 is passed through the hole.

Movable element 400 is a movable iron core formed in a columnar shape. Movable element 400 is disposed on the lower side of stator 541 in a housed state in cylindrical body 53. An upper end surface of movable element 400 is opposed to the lower end surface of stator 541. An outer diameter of movable element 400 is formed to be substantially the same as the outer diameter of stator 541. Movable element 400 is movable along direction D1 in a state of being disposed to have the same axis as the center axis of excitation coil 2. Movable element 400 is movable between the first position at which its upper end surface is in contact with the lower end surface of stator 541 and the second position at which its upper end surface is away from and not in contact with the lower end surface of stator 541. The lower end surface of stator 541 to be in contact with movable element 400 is referred to as contact face 542. That is, the position at which movable element 400 is in contact with contact face 542 becomes the first position.

In movable element 400, housing space 402 opened at its upper end surface and having a bottomed cylindrical shape is formed. A center axis of housing space 402 is the same axis as that of movable element 400. Return spring 401 is housed in housing space 402. Return spring 401 is a coil spring that is in contact with stator 541 and movable element 400 to bias movable element 400 in the lower direction (second position). Return spring 401 is housed in housing space 402 while being compressed when movable element 400 is attracted to stator 541 to move from the second position to the first position, enabling movable element 400 to be in contact with stator 541. Shaft 41 is passed inside return spring 401. To movable element 400, a distal end of shaft 41 passed inside housing space 402 and return spring 401 is fixed.

As described above, stator 541 of the exemplary embodiment is integrally formed with the first end (yoke upper plate 54 in the exemplary embodiment) of yoke 5.

The above configuration makes it easy to magnetically combine stator 541 and the first end of yoke 5 (yoke upper plate 54) and fix the position of stator 541 to yoke 5 by integrally forming the first end of yoke 5 (yoke upper plate 54) and stator 541.

In the exemplary embodiment, housing space 402 for housing return spring 401 is formed in movable element 4. Consequently, it is not needed to form a housing space for housing a return spring in stator 541, making it easy to form stator 541. Furthermore, it is possible to reduce the number of parts of electromagnetic device 1D by integrally forming stator 541 and yoke upper plate 54.

Note that, like the exemplary embodiment, yoke upper plate 51 and stator 3 may be integrally formed in each of the first exemplary embodiment, the first modification of the first exemplary embodiment, the second modification of the first embodiment, and the second exemplary embodiment.

REFERENCE MARKS IN THE DRAWINGS

1, 1A, 1B, 1C, 1D: electromagnetic device
11: contact device
100, 100A, 100B, 100C, 100D: electromagnetic relay
2, 141: excitation coil
3, 143, 541: stator
4, 400: movable element
43: step portion
44: non-contact portion
441: lower end surface
45: contact portion
451: upper end surface
5, 144: yoke
50, 50C: yoke side plate
51, 54: yoke upper plate (first end)
52: yoke lower plate (second end)
6: yoke extension
61: step portion
62: small diameter portion
63: large diameter portion
64: end (end in direction D1 of yoke extension 6)
31, 542: contact face (region of stator to be in contact with movable element)
121: movable contact
122: fixed contact
D1: direction
F1, F2, F3: magnetic flux

The invention claimed is:

1. An electromagnetic device comprising:
an excitation coil;
a stator surrounded by the excitation coil, the stator having a first end;
a movable element surrounded by the excitation coil and configured to, when current is flown in the excitation coil, be attracted to the stator by magnetic flux generated at the excitation coil to move in a first direction from a first position to a second position, wherein the movable element is in contact with the first end of the stator when the movable element moves to the second position;
a yoke having a first end and a second end, and forming a part of a magnetic path for the magnetic flux generated at the excitation coil, wherein the first end of the yoke is magnetically combined with the stator, the second end of the yoke is positioned on a side of the first position of the movable element, and the excitation coil is disposed between the first end of the yoke and the second end of the yoke; and
a yoke extension connected to the second end of the yoke and extending from the second end of the yoke to the first end of the stator, the yoke extension being magnetically combined with the yoke, the stator, and the movable element,
and
wherein the yoke extension surrounds entirety of the movable element positioned between the first position and the second position and surrounds the first end of the stator.

2. The electromagnetic device according to claim 1, wherein the stator and the yoke are separately formed.

3. The electromagnetic device according to claim 1, wherein the stator and the yoke are integrally formed.

4. The electromagnetic device according to any one of claim 1, wherein
the movable element includes a contact portion to be in contact with the stator, and a non-contact portion to be not in contact with the stator, and
in a second direction perpendicular to the first direction, a distance from an outer surface of the non-contact portion to an inner surface of the yoke extension is larger than a distance from an outer surface of the contact portion to the inner surface of the yoke extension.

5. An electromagnetic relay comprising:
the electromagnetic device according to claim 1; and
a contact device,
wherein
the contact device includes a fixed contact and a movable contact,
the movable contact moves with a movement of the movable element,
the movable contact is in contact with the fixed contact when the movable element is in contact with the stator,
the movable contact is away from the fixed contact when the movable element is away from the stator, and
the electromagnetic device and the contact device are aligned along the first direction.

6. The electromagnetic device according to claim 1,
wherein when current is flown in the excitation coil, a first magnetic path is formed by the yoke, the yoke extension and the stator, and a second magnetic path is formed by the yoke, the yoke extension, the movable element and the stator, and
wherein a magnetic resistance of the first magnetic path is smaller than a magnetic resistance of the second magnetic path.

* * * * *